US007859377B2

(12) United States Patent
Kawarai

(10) Patent No.: US 7,859,377 B2
(45) Date of Patent: Dec. 28, 2010

(54) COIL COMPONENT

(75) Inventor: Mitsugu Kawarai, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 12/213,409

(22) Filed: Jun. 19, 2008

(65) Prior Publication Data

US 2009/0002117 A1 Jan. 1, 2009

(30) Foreign Application Priority Data

Jun. 26, 2007 (JP) ..... 2007-167364

(51) Int. Cl.
*H01F 27/02* (2006.01)

(52) U.S. Cl. ..... 336/83

(58) Field of Classification Search ..... 336/65, 336/83, 200, 205–208, 232
See application file for complete search history.

(56) References Cited

U.S. PATENT DOCUMENTS

2003/0227366 A1* 12/2003 Lin ..... 336/221
2006/0214759 A1 9/2006 Kawarai

FOREIGN PATENT DOCUMENTS

JP 07288210 A * 10/1995
JP 2001307933 A * 11/2001
JP 2005-268369 9/2005

* cited by examiner

*Primary Examiner*—Tuyen Nguyen
(74) *Attorney, Agent, or Firm*—Manabu Kanesaka

(57) ABSTRACT

A coil component is provided, and the coil component for an inductor is deformable dependent on flex of a flexible printed board due to elapse of time when mounted thereon, and has high resistance against dropping impact and has an inductance value. The coil component includes an anisotropic compound magnetic sheet which is layered on at least any one or both of the upper surface and the lower surface of an air core coil formed spirally in a plane and which is composed of flat or needle-shaped soft magnetic metal powder, which has a major axis and a minor axis and is dispersed in a resin material, the major axis of which corresponds to an in-plane direction of the air core coil.

20 Claims, 6 Drawing Sheets

COIL COMPONENT

BACKGROUND OF THE INVENTION

1. Field of the Invention

The present invention relates to a coil component used in a power supply circuit and the like for a mobile device such as a mobile phone.

2. Description of the Related Art

As a conventional coil, an inductor laminated ferrite sintered bodies which have respectively a built-in conductor, has been widely used as disclosed in Japanese Patent Application Laid-Open (JP-A) No. 2005-268369. In the inductor, a core body is very brittle and is fragile against bending and shock impact. For this reason, when the inductors are used in power supply circuits and the like for a mobile device, a problem arises in that it is liable to be broken by deflection, deformation due to elapse, or dropping impact of a substrate.

To solve the problem, there is proposed a flexible inductor configured such that a compound magnetic material (compound magnetic sheet) obtained by mixing a magnetic powder with a resin is layered on a film type coil, as shown in JP-A-2006-303405 and the corresponding US Publication No. US2006/0214759A1. The flexible inductor has a mechanical advantage in that it is less brittle, can be mounted on a flexible printed board, and is resistant against deflected deformation and drop shock.

However, since recent mobile device is to more reduce its size and to more increase an output, the flexible inductor disclosed in US2006/0214759A1 is also required to more improve an inductance value.

SUMMARY OF THE INVENTION

An object of the present invention, which has been made to solve the above problems, is to provide a coil component which can be deformed itself by following the flex, which is caused as a time elapses, of a flexible printed board on which it is mounted, is highly resistant against drop shock, and has a high inductance value.

To achieve the present invention, the inventors have paid attention to that the magnetic powder contained in the resin in the conventional flexible inductor described in US2006/0214759A1 uses ordinary metal magnetic powder and soft magnetic ferrite powder, that is, a compound magnetic sheet in the inductor is made by simply dispersing isotropic magnetic powder to the resin. The inventors have completed the present invention based on a technical idea that the mechanical merit of a flexible inductor can be obtained and further the inductance value of the inductor can be improved by increasing the magnetic permeability of a compound magnetic sheet according to the direction in which a magnetic flux radiated by the inductor passes.

That is, the features of the coil component of the present invention reside in the following arrangements:

(1) A coil component is comprised of an air core coil which is spirally formed in a planar state, and an anisotropic compound magnetic sheet which is layered on at least one of upper and lower surfaces of the air core coil, wherein the anisotropic compound magnetic sheet is composed of flat or needle-shaped soft magnetic metal powder having a major axis and a minor axis, and being dispersed in a resin material, and the major axis of the soft magnetic metal powder orients toward an in-plane direction of the air core coil having flexibility.

(2) The coil component according to the item 1, wherein at least one of a central core and a periphery of the air core coil is filled with an isotropic compound magnetic material which is composed of isotropic soft magnetic metal powder dispersed in a resin material.

(3) The coil component according the item 1, wherein at least one of a central core and a periphery of the air core coil is filled with an anisotropic compound magnetic material which is composed of flat or needle-shaped soft magnetic metal powder having a major axis and a minor axis, and being dispersed in a resin material is filled in, and the major axis of the soft magnetic metal powder which is dispersed in the anisotropic compound magnetic material orients toward an orthogonal surface direction of the air core coil.

The object of the present invention can be also achieved by the following specific aspects:

(4) The coil component according to any of the items (1) to (3), wherein an average winding diameter of the air core coil is larger than the thickness of the air core coil.

(5) The coil component according to any of the items (1) to (4), wherein the anisotropic compound magnetic sheet is layered on both the upper and lower surfaces of the air core coil.

(6) The coil component according to any of the items (1) to (5), wherein the air core coil is a film type coil in which a conductor pattern is formed on a resin film.

(7) The coil component according to the item (6), wherein the resin film is provided with cutouts at positions corresponding to the central core and the periphery of the air core coil. The coil component of the present invention according to the item (1) has the flexibility. Thus, when the coil component is mounted on a flexible printed circuit board, the coil component can be deformed by itself following the flexing deformation of the printed circuit board caused by passage of time, thereby the mechanical merit of the conventional flexible inductor such as prevention from breakage due to brittleness and the like can be obtained.

Further, the coil component of the present invention which is comprised of the air core coil and wound in the plane state and layered the compound magnetic sheet thereon, is formed thin to such a degree that it has flexibility. Therefore, almost all the portion of a magnetic path, through which the magnetic flux radiated from one end in the thickness direction of the air core coil flows back to the other end, is composed of the compound magnetic sheet which extends in the in-plane direction respectively on the upper and lower end surfaces of the air core coil.

Accordingly, in the coil component of the present invention, the magnetic permeability of the compound magnetic sheet (i.e. anisotropic compound magnetic sheet) becomes high in the in-plane direction and low in the direction orthogonal with the surface of the air core coil by forming the soft magnetic metal powder dispersed in the compound magnetic sheet to the flat shape or the needle-shape and further causing the major axis direction of the powder thereof to be in coincidence with the in-plane direction of the air core coil (hereinafter, it may refer to "the soft magnetic metal powder is oriented in the horizontal direction"). As a result, the magnetic permeability of the overall magnetic path through which the magnetic flux passes mainly in the in-plane direction through the compound magnetic sheet is increased, thereby the inductance value of the coil component can be improved.

In the coil component according to the item (2) which is the more specific aspect of the present invention, the soft magnetic metal powder dispersed in the compound magnetic material with which the central core and the periphery of the air core coil are filled has the isotropic shape. Accordingly, the magnetic permeability of the inside and the outside of the air core coil wound through which the magnetic flux passes in the thickness direction of the coil component can be made the same as the magnetic permeability in the in-plane direction and in the direction orthogonal with the surface direction of the air core coil without applying special orientation to the soft magnetic metal powder. With this arrangement, the magnetic permeability of the magnetic path can be increased in its entirety, without increasing the number of processes to thereby improve the inductance value when compared with a coil component in which soft magnetic metal powder is horizontally oriented in a central core and a periphery likewise an anisotropic compound magnetic sheets layered on the upper and lower surfaces of an air core coil.

Further, in the coil component according to the item (3) which is the more specific aspect of the present invention, the soft magnetic metal powder dispersed in the compound magnetic material with which the central core and the periphery of the air core coil are filled is formed to the flat shape or the needle-shape as well as the major axis direction of the metal powder is caused to be in coincidence with the direction orthogonal with the surface (i.e. the thickness direction) of the air core coil (hereinafter, it may refer to "the soft magnetic metal powder is vertically oriented"). With this arrangement, the magnetic permeabilities of the regions are reduced in the in-plane direction of the air core coil and increased in the direction orthogonal with the surface thereof. That is, the magnetic permeabilities of the compound magnetic sheets on the upper and lower surfaces of the air core coil, through which the magnetic flux mainly passes in the in-plane direction of the coil component, are increased in the in-plane direction, and the magnetic permeabilities of the inside and the outside of the coil, through which the magnetic flux mainly passes in the thickness direction of the coil component, are increased in the thickness direction. This makes it possible to increase the magnetic permeability of the overall magnetic path through which the magnetic flux radiated from the coil component passes and thus to improve greatly the inductance value.

Since the coil component according to the present invention not only more improves the inductance value than the conventional inductor but also uses the soft magnetic metal powder which has a large maximum saturation magnetic flux density as the magnetic material to be dispersed in the resin material, the coil component can also obtain the excellent superimpose direct-current characteristics.

BRIEF DESCRIPTION OF THE DRAWINGS

FIGS. 2A to 2C are plan views showing processes for manufacturing the inductor of the embodiment, wherein FIG. 2A is a plan view showing a state that an air core coil is formed on a base film, FIG. 2B is a plan view showing a state that a conductor is connected to the air core coil, and FIG. 2C is a plan view showing a state that the base film having the air core coil is mounted on an anisotropic compound magnetic sheet;

FIGS. 3D to 3F are plan views showing processes for manufacturing the inductor of the embodiment, wherein FIG. 3D is a plan view showing a state that cutouts of the base film are filled with a compound magnetic material, FIG. 3E is a plan view showing a state that the anisotropic compound magnetic sheet is mounted on the air core coil and they are integrated with each other, and FIG. 3F is the plan view showing a state that external electrodes are connected to the base film;

DETAILED DESCRIPTION OF THE PREFERRED EMBODIMENTS

Preferred embodiments of the present invention will be explained below in detail with reference to the drawings. Inductors shown in embodiments of the present invention are examples preferably used for a power supply circuit and the like of mobile device such as a mobile phone.

Figure 1A:
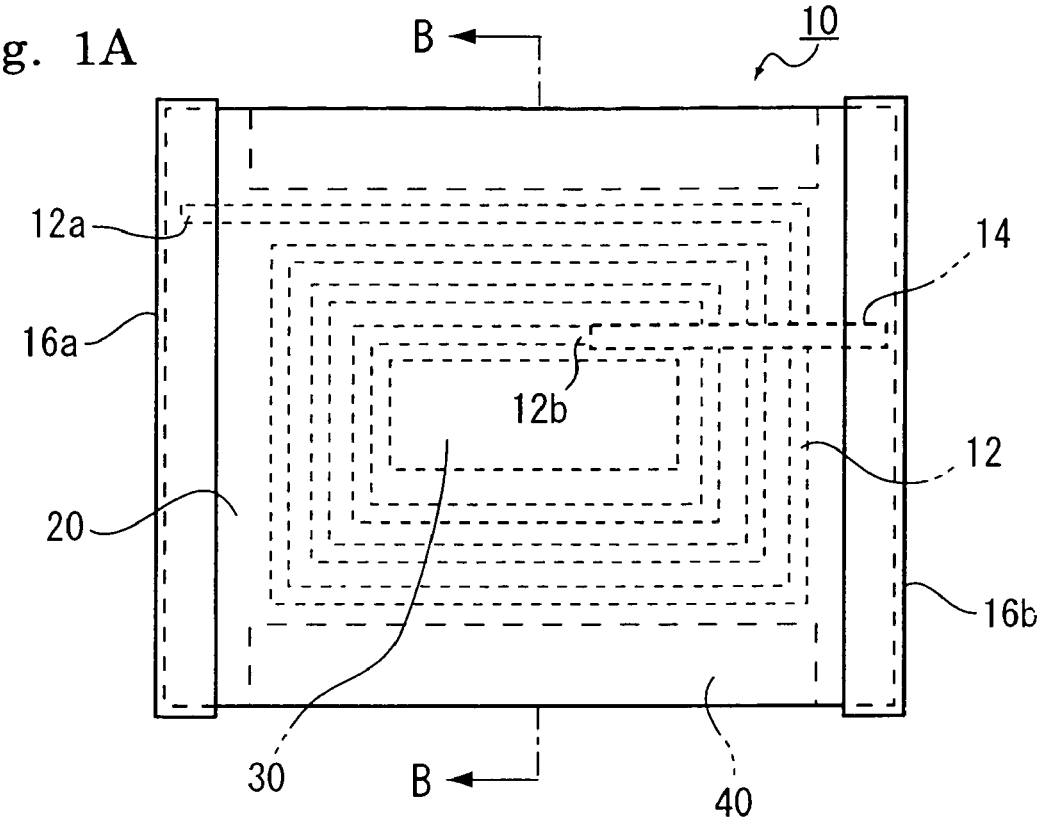
FIG. 1A is a plan view of an inductor according to a first embodiment of the present invention.
Figure 1B:
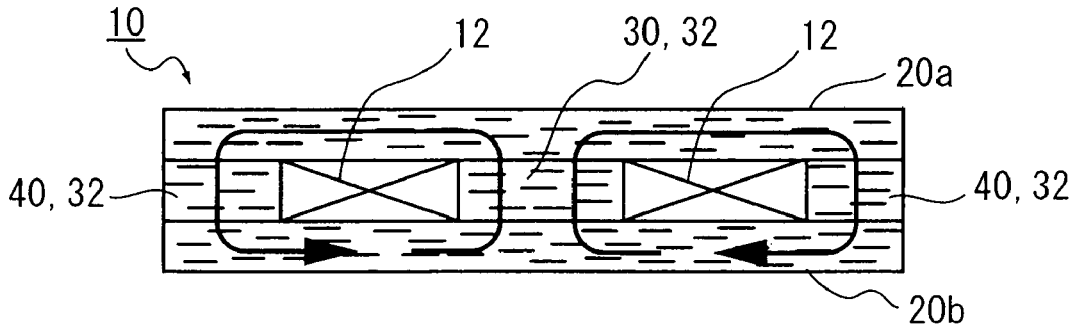
FIG. 1B is a schematic sectional view of the inductor taken along the line B-B of FIG. 1A.

FIG. 1A is a plan view of an inductor 10 according to a first embodiment, and FIG. 1B is a schematic sectional view of the inductor taken along the line B-B of FIG. 1A. A thickness direction of the inductor 10 is a front and rear direction of a sheet of FIG. 1A and an up and down direction of a sheet of FIG. 1B. FIGS. 2A to 2C and FIGS. 3D to 3F are plan views showing processes for manufacturing the inductor 10 of the embodiment.

The inductor 10 of the embodiment has a plane size of several to several tens of millimeters×several to several tens of millimeters and a thickness of about several hundreds of micron meters.

The inductor 10 of the present invention has flexibility in its entirety, because an air core coil 12 and an anisotropic compound magnetic sheet 20 (i.e. 20*a*, 20*b*), which constitute the inductor 10, are formed thin and have flexibility.

Air Core Coil:

The air core coil 12 for use in the inductor 10 of the embodiment has a conductor pattern spirally wound a plurality of times in a state of plane. More specifically, the air core coil 12 excludes a winding inductor composed of a wire wound around a ferrite core and the like in the direction in which the winding axis of the core extends, and a layered inductor formed by laminating green sheets which are composed of a ferrite material or a ceramic material and on each of which a fraction of turn of a coil is printed.

The material, the number of times of winding, and the specific spiral shape of a spiral conductive pattern constituting the air core coil 12 are not particularly limited as long as inductance is generated by energization.

Three typical methods of manufacturing the air core coil 12 will be exemplified below:

(A) an etching method of bonding a metal foil such as a rolled copper foil on a resin film, patterning it to a spiral shape by resist exposure, and subjecting it to chemical etching;

(B) a plating method of plating molten metal on a resin film to a spiral shape through a mask pattern opened in the spiral shape;

(C) a winding method of winding a magnet wire composed to thin metal wire whose surface is insulated to the spiral shape.

A resin film (base film) used in the etching method (A) and the plating method (B) is preferably a film having corrosion resistance and heat resistance to withstand etching and plating, and specifically, a resin material such as polyimide and PET (polyethylene terephthalate) formed to a film having a thickness of about 10 to 100 μm may be used.

In the wiring method (C), a base film composed of the above or other resin material may be used as a base member around which the magnet wire is wound or only the magnet wire may be wound without using the base member.

Further, in the methods (A) and (B), another resin film (insulation film) is preferably bonded on the upper surface of the resin film (base film), on which the air core coil 12 is formed, so as to clamp the air core coil 12 in order to insulate the surface of a conductor pattern constituting the air core coil 12. The same resin material as the base film may be used as the insulation film. However, since it is not requested to have corrosion resistance and heat resistance different from the base film, a different type of a material may be used.

Figure 2A:
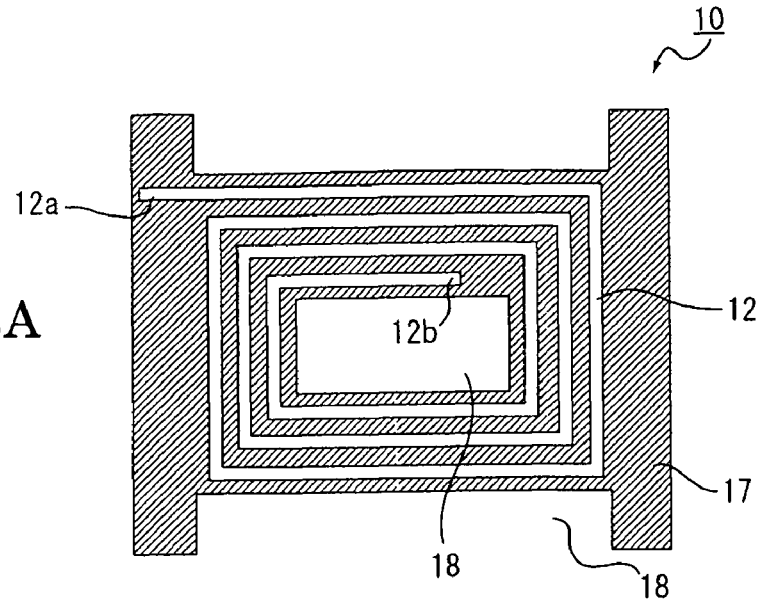

In the embodiment shown in FIG. 2A, the air core coil 12 is provided by spirally forming of the conductor pattern on the base film 17 and further laminating an insulation film (not shown) thereon.

As shown in FIG. 1A, an outermost end 12*a* of the spiral air core coil 12 is drawn out to one side of the inductor 10 in the width direction (right to left direction in the drawings) thereof and electrically connected to an external electrode 16*a* (one of external electrode 16*a*, 16*b*). The external electrodes 16*a*, 16*b* (generally shown by the numeral of 16) are terminal electrodes for mounting the inductor 10 of the embodiment on a printed board and the like. Accordingly, the external electrode 16 is formed to such a thickness that it slightly projects from a surface of the inductor 10.

Figure 2B:
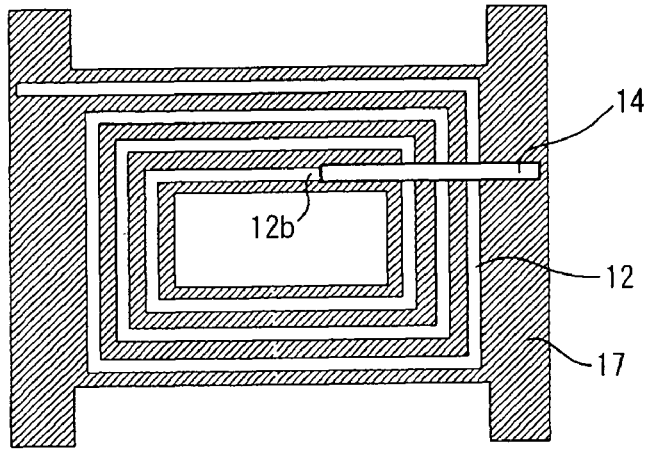

Further, a conductor 14 is electrically connected to an innermost end 12*b* of the spiral air core coil 12 as shown in FIG. 2B, and the external electrode 16*b* disposed to the other end of the inductor 10 in the width direction thereof conducts to the innermost end 12*b* (refer to FIG. 1A). The conductor 14 does not conduct to the conductor pattern except the innermost end 12*b* to prevent the air core coil 12 from being shot-circuited. Accordingly, the conductor 14 is preferably disposed to the opposite side of the conductor pattern across the base film and the insulation film. Further, to cause the conductor 14 to conduct to the innermost end 12*b*, a through hole is preferably formed to the base film or the insulation film at a position corresponding to the innermost end 12*b* so that the innermost end 12*b* is exposed therethrough and one end of the conductor 14 is preferably connect thereto. The other end of the conductor 14 is connected to the external electrode 16*b* as described above.

The external electrode 16 may be previously mounted on the base film 17, to which the air core coil 12 and the conductor 14 are patterned, before other layers such as an anisotropic compound magnetic sheet 20 and the like to be described later are layered thereon, or may be mounted on the base film 17 after the other layers are layered. In the embodiment, after the anisotropic compound magnetic sheets 20 are layered on the upper and lower surfaces of the base film 17, the external electrode 16 is connected to the base film 17 exposed from the anisotropic compound magnetic sheet 20 as shown in FIG. 3F. With this arrangement, when a plurality of the inductors 10 are manufactured by a so-called multiple attachment, the external electrode 16 projecting in a thickness direction does not inhibit a laminating work operation of the anisotropic compound magnetic sheet 20.

In the present invention, the air core coil 12 may be composed of two conductor patterns which are respectively formed spirally to connect both the ends of the air core coil 12 to the external electrodes 16*a* and 16*b*, respectively. That is, a series of the air core coils 12 may be manufactured by the two conductor patterns layered so as to be located the outermost ends 12*a* of the air coil 12 to the right and left opposite sides in the width direction of the inductor 10 and the innermost ends 12*b* thereof coincide with each other and are connected electrically.

In this instance, it is preferable to dispose the conductor patterns on both the upper and lower sides respectively so as to sandwich the base film 17 therebetween, and to connect electrically the innermost ends 12*b* to each other via a through-hole provided to the base film 17 in order to prevent the two conductor patterns from being short-circuited.

Since the number of times of winding of the conductor pattern spirally formed on one base film 17 is limited in a manufacture process, the air core coil 12 may be arranged by layering a plurality of conductor patterns with insulation films respectively sandwiched therebetween each having a through hole to obtain the desired number of times of winding of the air core coil 12. In this instance, it is sufficient to connect electrically the ends of the air core coils 12 located to the lowermost layer and the uppermost layer of the layered conductor patterns to the external electrodes 16 and 16*b* respectively through the conductor 14, if necessary.

The air core coil 12 of the present invention is characterized to be formed spirally in the plane. With regard to the word "plane" referred to herein, there is no need to accurately constitute as referred in a mathematic meaning. More specifically, the description of "the air core coil 12 is spirally formed in the state of plane" refers to a case that "the inductor 10 can be formed thin in its entirety as well as the air core coil 12 can obtain sufficient flexibility by itself and the thickness of the air core coil 12 is formed equal to or less than several times of the wire thickness of the conductor pattern".

Moreover, the description of "the air core coil 12 is spirally formed in the plane" in a case that the air core coil 12 is arranged by laminating a plurality of conductor patterns means that the respective conductor patterns are spirally formed in the plane defined as described above.

In the spirally formed air core coil 12, a central core 30 located inward of the conductor pattern and a periphery 40 located outward thereof are filled with a compound magnetic material 32 composed of soft magnetic metal powder dispersed in a resin material. The magnetic flux density of the air core coil 12 is improved by filling the central core 30 with the compound magnetic material 32. In addition, closed magnetic paths of the magnetic flux radiated by the air core coil 12 are formed as shown by arrows of FIG. 1B and the inductance value of the inductor 10 can be improved by filling the periphery 40 with the material.

As shown in the drawings, in a case of the inductor 10 in the embodiment formed in the rectangular shape when viewed in the plan view, the periphery 40 which will be filed up may be formed along the overall peripheral portion of the spiral conductor pattern, or may be formed to the four sides of the rectangular shape, or may be formed to both the upper and lower sides where the external electrode 16 is not disposed as illustrated. The orientation of the soft magnetic metal powder, which is dispersed in the compound magnetic material 32 with which the central core 30 and the periphery 40 are filled, will be described later.

When the air core coil 12 is formed to the base film 17 as described in the above-mentioned item (A) or (B) described above, it is preferable to form cutouts to the portions of the base film 17 corresponding to the central core 30 and the periphery 40 of the air core coil 12. In the embodiment, the rectangular central core 30 is disposed inward of the innermost end 12*b* of the air core coil 12, and the periphery 40 is disposed to outside of the winding portion of the air core coil 12 along the upper and lower sides of the rectangular base film 17. Accordingly, the cutouts 18 are formed by punching the position of the surface center and the positions along the upper and lower sides of the base film 17 shown in FIG. 2A.

Explanation of Anisotropic Compound Magnetic Sheet:

The inductor 10 of the present invention is characterized in that the anisotropic compound magnetic sheet 20 is layered on at least any one of the upper surface or the lower surface (i.e. the front surface or the rear surface) of the air core coil 12. In the inductor 10 of the embodiment whose sectional view is shown in FIG. 1B, the anisotropic compound magnetic sheets 20 (20*a*, 20*b*) are layered together on both the upper and lower sides of the air core coil 12.

The anisotropic compound magnetic sheet 20 is composed of a compound magnetic material formed in a sheet shape having a thickness of about several tens to several hundreds of micrometers. The compound magnetic material is composed of flat or needle-shaped soft magnetic metal powder (anisotropic metal powder), that has a major axis direction and a minor axis direction, dispersed in a resin material.

An inductor composed of conductive metal magnetic films layered on the upper and lower surfaces of the air core coil 12 has a fear of occurrence of the loss of an inductance value due to an eddy current loss. However, in the present invention arranged such that the anisotropic compound magnetic sheet 20 composed of the compound magnetic material is layered on the upper surface and/or the lower surface of the air core coil 12, the loss of the inductance value caused by the eddy current loss does not occur.

The inductor 10 of the present invention has a further feature in that since the major axis direction of the soft magnetic metal powder faces the in-plane direction of the air core coil 12, the magnetic permeability of the anisotropic compound magnetic sheet 20 is larger in the in-plane direction thereof than the orthogonal surface direction thereof.

When the anisotropic compound magnetic sheet 20 is disposed on the upper surface and/or the lower surface of the air core coil 12, the magnetic permeabilities of the upper and lower surfaces constituting the main magnetic paths of the magnetic flux radiated from the air core coil 12 is increased in a direction in which the magnetic flux passes.

Flat or needle-shaped metal powder of a metal material can be used as the soft magnetic metal powder. Specifically, a mixture of one or two or more kinds of the powder of pure iron, iron-nickel alloy, iron-cobalt alloy or iron-aluminum-silicon alloy as iron polycrystalline metals and iron amorphous metals or cobalt amorphous metal as amorphous metals, and the like can be used.

There are merits in a manufacturing process to use powder composed of the above metal whose crystals are grown to a flat shape or a needle shape as the soft magnetic metal powder rather than to use the powder of ferrite as a sintered iron oxide, which is broken to a flat shape or a needle shape. Ferrite powder, which is obtained by mixing an unsintered raw ferrite material formed to a flat shape or a needle shape with a resin material described below and sintering them, is not preferable as the soft magnetic metal powder because the flexibility of the resin material is lost.

Further, in general, it can be said that the metal magnetic material is more preferable rather than the ferrite magnetic material to cope with an increase of output (application of large current) when it is used as the coil component because the metal magnetic material has a large maximum saturation magnetic flux density as one of typical magnetic characteristics.

The soft magnetic metal powder used in the present invention has the major axis and the minor axis. A flat powder is obtained by shrinking approximately spherical powder in one direction which is the minor axis. On the other hand, a needle-shaped powder is obtained by extending the approximately spherical powder in one direction which is the major axis.

Although the average length of a major axis to the average length of a minor axis is not particularly limited in principle as long as it does not exceed 1, it is set to 2.5 or more and preferably to 12 or more to improve the inductance value of the inductor 10 by significantly improving the magnetic permeability of the magnetic paths of the air core coil 12.

Flexible elastomer and plastomer can be used as the resin material acting as a binder for dispersing the soft magnetic metal powder, and as specific examples thereof, it is enumerated polyester resin, polyvinyl chloride resin, polyurethane resin, cellulose resin, polyamide resin, polyimide resin, silicon resin, and epoxy resin etc.

At the time, the resin material used for the compound magnetic material is preferably a resin having a glass transition temperature of −20° C. or less. In particular, silicon resin, and polyurethane resin, epoxy resin, and the like with a low degree of cross-linking, which have rubber elasticity at a room temperature, are preferably used. As a result, the inductor 10 has a merit in that it has a greatly reduced elastic modulus in its entirety, and it is made soft, and is responsive to deformation caused by external force, and unlike to be broken.

The soft magnetic metal powder is dispersed in the resin material as well as horizontally oriented so that the major axis direction thereof faces the sheet in-plane direction of the anisotropic compound magnetic sheet 20.

The following four methods will be exemplified for horizontally orienting the soft magnetic metal powder:

(a) a doctor blade method of smoothing the long axis direction of the soft magnetic metal powder in the sheet in-plane direction by mixing the soft magnetic metal powder, the resin material and a solvent to prepare a slurry, forming the slurry to a thin film on a substrate while extending it like a sheet using a doctor blade, and further pressing the thin film of the slurry at a room temperature;

(b) a screen printing method of smoothing the long axis direction of the soft magnetic metal powder in the sheet in-plane direction by mixing the soft magnetic metal powder, the resin material and a solvent to prepare a slurry, forming the slurry in a thin film on a substrate by screen printing, and further pressing the thin film of the slurry at a room temperature;

(c) a spray coating method of mixing the soft magnetic metal powder, the resin material and a solvent to prepare a slurry, spraying and coating the slurry on a substrate to obtain an ultra thin film thereof for falling the soft magnetic metal powder laterally thereby, repeating the spray coating to obtain a thin film having a desired thickness, and pressing the thin film at a room temperature; and (d) a heat pressing method of horizontally orienting the soft magnetic metal powder by kneading the soft magnetic metal powder and the resin material under a heating condition equal to or higher than the melting temperature of the resin material, and further heat pressing the kneaded substance on a substrate.

Xylen, toluene, IPA (isopropyl alcohol), and the like can be used as the solvent used in the methods (a) to (c). It has become apparent from the examination of the inventors of the present invention that the horizontal orientation capability of the soft magnetic metal powder can be adjusted in the respective methods (a) to (c) by increasing or decreasing the mixing ratio of the soft magnetic metal powder and the resin material to the solvent so as to adjust the viscosity of the slurry. Further, it has become also apparent that the horizontal orientation capability of the soft magnetic metal powder can be adjusted in the respective methods (a) to (d) by increasing or decreasing the major axis/minor axis ratio (aspect ratio) of the soft magnetic metal powder.

Further, when the soft magnetic metal powder cannot be sufficiently oriented horizontally particularly in the screen printing method (b) within the methods (a) to (c), the major axis direction of the soft magnetic metal powder is liable to face a magnetic field application direction by applying an, external magnetic field in the horizontal direction of the substrate, thereby the horizontal orientation of the powder is accelerated.

When the inductor 10 of the embodiment is manufactured, first, the anisotropic compound magnetic sheets 20*a*, 20*b* made by any of the above stated methods are prepared.

Figure 2C:
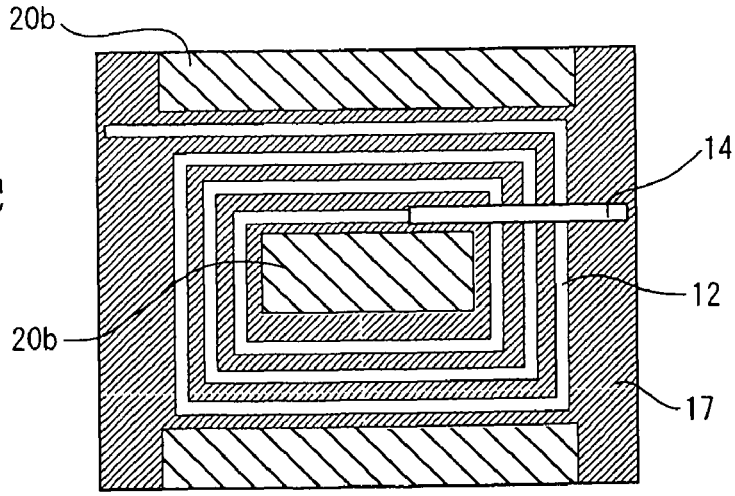

Next, the base film 17 having the air core coil 12 is placed on the anisotropic compound magnetic sheet 20 (20*b*) on the one hand (FIG. 2C).

Figure 3D:
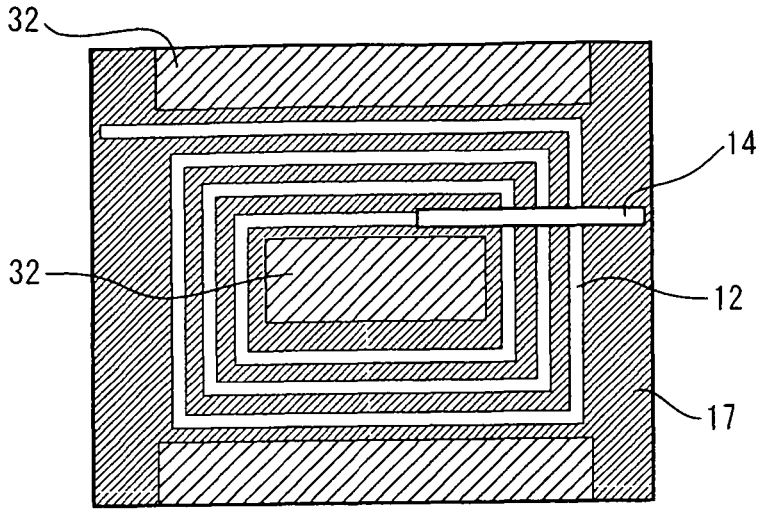

The cutouts 18 of the base film 17 constituting the air core coil 12 are filled with the compound magnetic material 32 composed of the soft magnetic metal powder dispersed in the resin material (FIG. 3D).

Figure 3E:
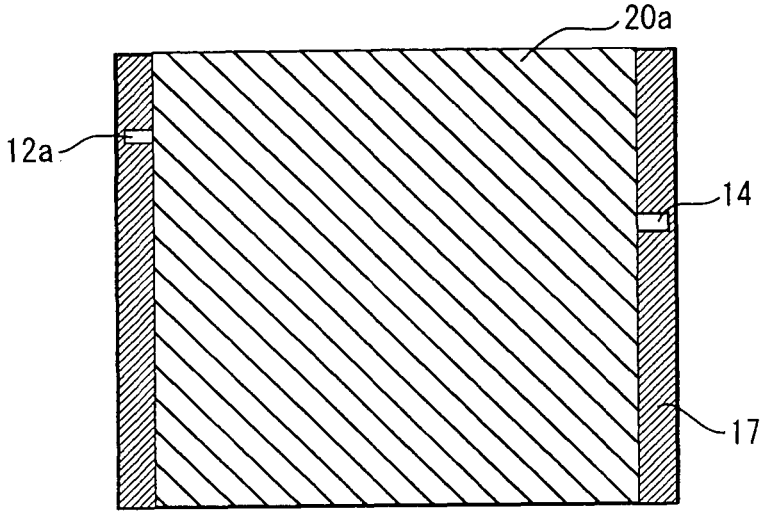
Figure 3F:
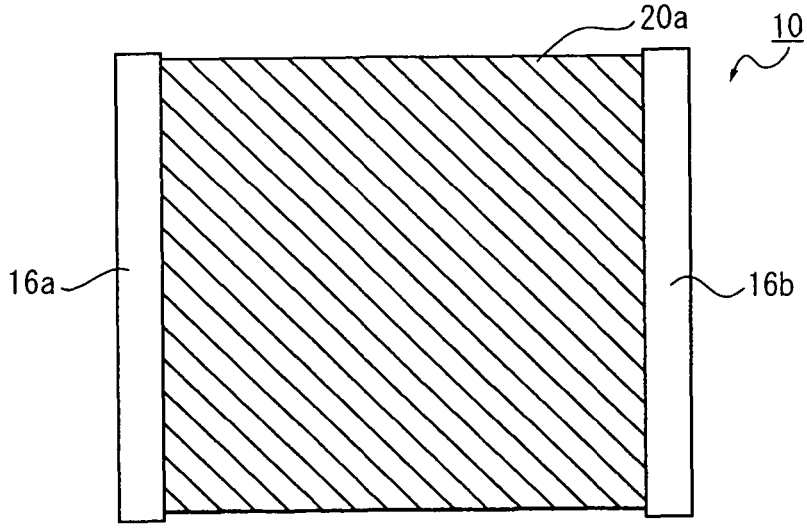

Further, the other anisotropic compound magnetic sheet 20 (20*a*) is placed on the air core coil 12 and they are thermally fused and integrated with each other by heat-press (FIG. 3E).

The external electrodes 16*a* and 16*b* are attached to the base film 17 exposed from the anisotropic compound magnetic sheet 20*a*, and the conductor 14 which is joined to the innermost end 12*b* of the air core coil 12, and the outermost end 12*a* of the air core coil 12 are electrically connected to the external electrodes 16*a* and 16*b*, respectively, thereby the inductor 10 is produced.

It is more preferable to use the flat anisotropic metal powder rather than the needle-shaped anisotropic metal powder as the anisotropic metal powder dispersed in the anisotropic compound magnetic sheet 20. The reason is that it is preferable that the anisotropic compound magnetic sheet 20 has an isotropic magnetic permeability in the in-plane direction since the magnetic flux which is radiated from the air core coil 12, passes through the in-plane of the anisotropic compound magnetic sheet 20 in a radial direction from the center of the air core coil 12, and consequently the in-plane isotropic state can be obtained only by horizontally orienting the flat anisotropic metal powder which has an approximately circular shape in the major axis direction. In contrast, when the anisotropic compound magnetic sheet 20 is manufactured by used of the needle-shaped anisotropic metal powder, it is necessary to oriented horizontally needle-shaped powder in the radial direction by setting the load direction of an external magnetic field to the radial direction from the center of the air core coil 12.

It is preferably that the effective magnetic permeability in the in-plane direction of the anisotropic compound magnetic sheet 20 obtained as described above is twice or more, and more preferably thrice or more than the effective magnetic permeability in the orthogonal surface direction thereof. By providing the difference of twice or more between the effective magnetic permeabilities of the respective directions, the magnetic flux which is radiated from the air core coil 12 in the orthogonal surface direction, can be suppressed from passing through the anisotropic compound magnetic sheet 20 in the orthogonal surface direction. As a result, the magnetic flux is returned to the air core coil 12 through the approximately U-shaped magnetic paths passing through the in-surface of the anisotropic compound magnetic sheet 20 and the periphery 40 thereof.

In the inductor 10 of the embodiment as shown by the sectional view in FIG. 1B, the soft magnetic metal powder which is dispersed in the compound magnetic material filled to the central core 30 and the periphery 40, takes the flat or needle-shaped state and is horizontally oriented as well as the anisotropic compound magnetic sheet 20. In other words, the soft magnetic metal powder is oriented in a direction (right and left direction in the drawings) which intersects the direction (up and down direction in the drawings) in which the magnetic flux radiated by the air core coil 12 passes through the central core 30 and the periphery 40.

As described above, the magnetic flux, which is radiated from the upper edge of the air core coil 12 in the thickness direction thereof, is bent firstly in the in-plane direction of the anisotropic compound magnetic sheet 20, thereby suppressing the diffusion of the magnetic flux in the upper direction in the drawings. In other hand, since the plane dimension of the inductor 10 is sufficiently larger than the thickness dimension thereof as described above, a contact area is sufficiently secured between the anisotropic compound magnetic sheet 20 and the periphery 40. Accordingly, the magnetic flux flows from the anisotropic compound magnetic sheet 20 to the periphery 40 well, and returns to the lower end of the air core coil 12 without dependence on the orientation direction of the soft magnetic metal powder which exists in the periphery 40. This is the reasons that, even though the soft magnetic metal powder is horizontally oriented, the ration of diffusion in air of the magnetic flux which passes in-plane direction of the anisotropic compound magnetic sheet 20 is low, since the magnetic permeability of the compound magnetic material filled to the periphery 40 is sufficiently higher than that of air and the contact area is sufficiently secured between the anisotropic compound magnetic sheet 20 and the periphery 40 as described above. This is also the same as to the central core 30. That is, an effect of improving the magnetic flux density of the air core coil 12 is obtained by filling the central core 30 with the compound magnetic material 32, since the magnetic permeability of the compound magnetic material 32 is generally higher than that of air without dependence of the orientation direction of the soft magnetic metal powder.

In the present invention, the inductance value of the inductor 10 is further improved by adjusting the presence or, absence of orientation of the soft magnetic metal powder which is dispersed in the compound magnetic material 32 with which the central core 30 and the periphery 40 are filled, and adjusting the orientation direction of the metal powder as described below.

Figure 4A:
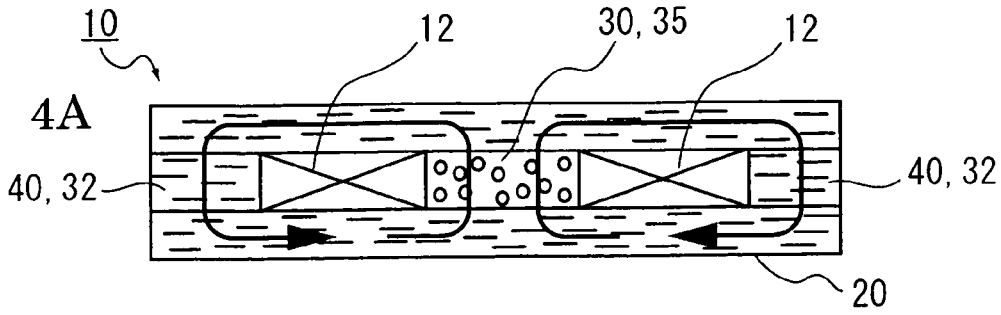
FIG. 4A is a schematic sectional view of an inductor according to a second embodiment.
Figure 4B:
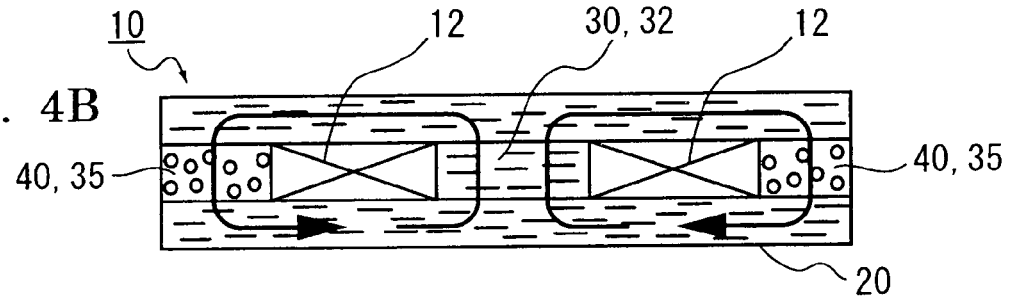
FIG. 4B is a schematic sectional view of an inductor according to a third embodiment.
Figure 4C:
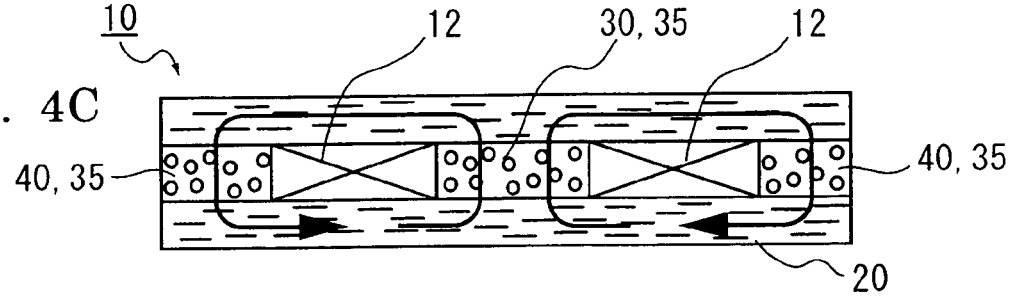
FIG. 4C is a schematic sectional view of an inductor according to a fourth embodiment.

Isotropic Compound Magnetic Material:

FIGS. 4A to 4C are schematic sectional views of inductors 10 according to second to fourth embodiments of the present invention taken along a line B-B (refer to FIG. 1A), respectively. The inductors 10 of the respective embodiments are characterized in that at least any one or both of a central core 30 and a periphery 40 of an air core coil 12 is filled with an isotropic compound magnetic material 35. Specifically, the central core 30 is filled with the isotropic compound magnetic material 35 in the second embodiment shown in FIG. 4A, the periphery 40 is filled with the isotropic compound magnetic material 35 in the third embodiment shown in 4B, and the central core 30 and the periphery 40 are filled with the isotropic compound magnetic material 35 in the fourth embodiment shown in FIG. 4C. In each of the second and third embodiments, the central core 30 or the periphery 40, which is not filled with the isotropic compound magnetic material 35, is filled with a compound magnetic material 32 composed of the anisotropic metal powder oriented horizontally in a resin material.

In the respective drawings, magnetic paths are shown by arrows when a magnetic flux is radiated from the upper end of the air core coil 12.

The isotropic compound magnetic material 35 is composed of isotropic soft magnetic metal powder (isotropic metal powder) dispersed in a resin material. For the isotropic compound magnetic material 35, it is available to use one or two or more kinds in mixture of the material of the anisotropic metal powder, the resin material as the binder, and the solvent for mixing them exemplified as the material for constituting the anisotropic compound magnetic sheet 20, except for that the particle shape of the soft magnetic metal powder used in the isotropic compound magnetic material 35 is different from that used in the anisotropic compound magnetic sheet 20.

It is preferable that the particle shape of the metal powder be approximately spherical and that the ratio of a major axis to a minor axis is less than 2 as the average shape thereof.

In the isotropic compound magnetic material 35, the isotropic metal powder need not be oriented in a predetermined direction. Accordingly, it is sufficient to fill, by a dispenser, the central core 30 and/or the periphery 40 with slurry obtained by mixing and uniformly stirring the isotropic metal powder and the resin material with the solvent.

The magnetic permeability of the central core 30 and the periphery 40 of each of the second to fourth embodiments will be more improved and the inductance value of the inductor 10, will be furthermore improved than the first embodiment shown in FIG. 1B, by filling the central core 30 and the periphery 40 with the isotropic compound magnetic material 35, which constitute magnetic paths through which a magnetic flux passes in the thickness direction of the inductor 10. Further, the second to fourth embodiments have merits that the isotropic compound magnetic material 35 will be easily obtained by uniformly just dispersing the isotropic metal powder in the resin material.

Figure 5A:
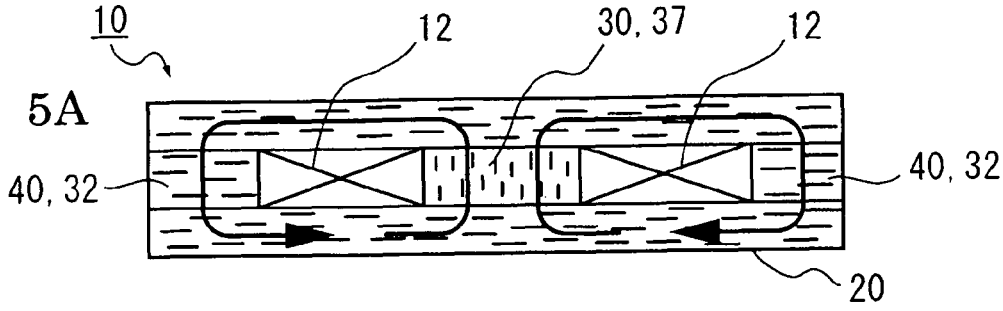
FIG. 5A is a schematic sectional view of an inductor according to a fifth embodiment.
Figure 5B:
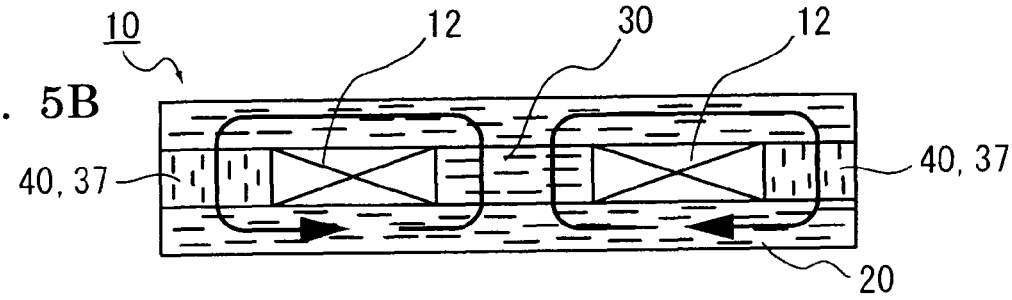
FIG. 5B is a schematic sectional view of an inductor according to a sixth embodiment.
Figure 5C:
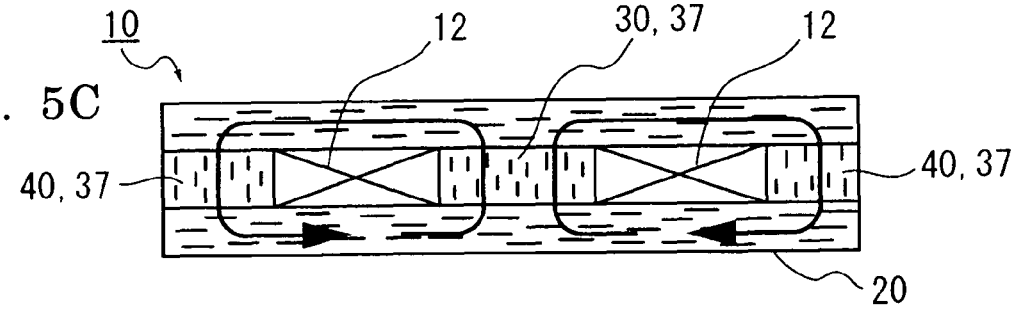
FIG. 5C is a schematic sectional view of an inductor according to a seventh embodiment.

In the present invention, the soft magnetic metal powder which is dispersed in the compound resin material for filling to the central core 30 and the periphery 40 is oriented vertically, accordingly, the major axis direction of the soft magnetic metal powder and the magnetic flux passing direction coincide each other, consequently the inductor value of the inductor 10 will be further improved. FIGS. 5A to 5C are schematic sectional views of inductors 10 according to fifth to seventh embodiments of the present invention taken along a line B-B (refer to FIG. 1A), respectively. The inductors 10 of the respective embodiments are characterized in that at least any one or both of a central core 30 and a periphery 40 of an air core coil 12 is filled with an anisotropic compound magnetic material 37 composed of anisotropic metal powder dispersed oriented vertically in a resin material. Specifically, the central core 30 is filled with the anisotropic compound magnetic material 37 in the fifth embodiment shown in FIG. 5A, the periphery 40 is filled with the anisotropic compound magnetic material 37 in the sixth embodiment shown in FIG. 5B, and the central core 30 and the periphery 40 are filled with the anisotropic compound magnetic material 37 in the seventh embodiment shown in FIG. 5C. In the fifth and sixth embodiments, the central core 30 or the periphery 40, which is not filled with the anisotropic compound magnetic material 37, is filled with the compound magnetic material 32 composed of the anisotropic metal powder oriented horizontally in the resin material.

In the respective drawings, magnetic paths are shown by arrows when a magnetic flux is radiated from the upper end of the air core coil 12.

Explanation of Anisotropic Compound Magnetic Material:

The anisotropic compound magnetic material 37 is composed of the soft magnetic metal material powder (i.e. anisotropic metal powder) in the flat or needle-shaped state which is dispersed in a resin material in the state that the metal powder is vertically orientated. For the anisotropic compound magnetic material 37, it is available to use one or two or more kinds in mixture of the material of the anisotropic metal powder and the particle shape thereof, the resin material as the binder, and the solvent for mixing them exemplified as the material for constituting the anisotropic compound magnetic sheet 20, except for that the orientation direction of the anisotropic metal powder used in the anisotropic compound magnetic material 37 is different from that used in the anisotropic compound magnetic sheet 20. The following methods will be exemplified as a method of vertically orientating the anisotropic metal powder in the resin material.

(i) A film coating method provided by coating slurry on a substrate to a predetermined film thickness and forming it to a thin film, which the slurry is obtained by mixing the anisotropic metal powder, the resin material and a solvent, and further by loading a forcible magnetic field to the thin film in the orthogonal surface direction of the substrate thereby to cause the major axis direction of the anisotropic metal powder to orient the orthogonal surface direction of the substrate.

(ii) A spray method provided by spraying and coating slurry onto the substrate under a forcible magnetic field environment in the orthogonal surface direction to form an ultrathin film and to make the anisotropic metal powder uprising, which the slurry is obtained by mixing the anisotropic metal powder, the resin material and a solvent, and obtaining the thin film of a desired thickness by repeating the spray coating step, and further by pressing the thin film at the normal temperature.

The particle shape of the anisotropic metal powder dispersed in the anisotropic compound magnetic material 37 may be any of a flat shape and a needle shape. The reasons are that since the magnetic permeability in the in-plane direction of the central core 30 and the periphery 40, through which a magnetic flux passes in the orthogonal surface direction, does not need to have an isotropic property, it is sufficient to vertically orient the particles by loading the forcible magnetic field in the orthogonal surface direction of the substrate even if any of flat particles and needle-shaped particles are used.

In each of the fifth to seventh embodiments, the magnetic permeability in the central core 30 and the periphery 40 and the inductance value of the inductor 10 are more improved than each of the second to fourth embodiments shown in FIGS. 4A to 4C by filling the central core 30 and the periphery 40, which constitute magnetic paths through which the magnetic flux passes in the thickness direction of the inductor 10, with the anisotropic compound magnetic material 37.

As a further modification of the present invention, one of the central core 30 and the periphery 40 will be filled with the isotropic compound magnetic material 35 composed of the isotropic metal powder dispersed in the resin material, and the other of them will be filled with the anisotropic compound magnetic material 37 composed of the anisotropic metal powder dispersed in the resin material in the vertically orientated state.

Figure 6A:
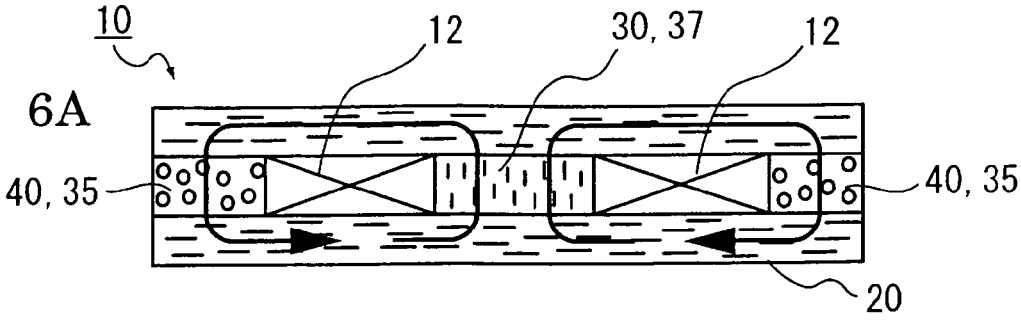
FIG. 6A is a schematic sectional view of an inductor according to an eighth embodiment.
Figure 6B:
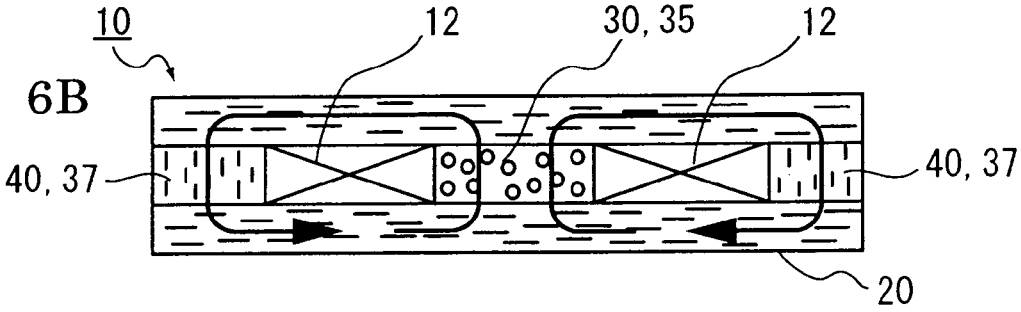
FIG. 6B is a schematic sectional view of an inductor according to a ninth embodiment.

FIG. 6A is a schematic sectional view of an inductor 10 according to an eighth embodiment of the present invention taken along the line B-B (refer to FIG. 1A), and the inductor 10 is characterized in that a central core 30 is filled with the anisotropic compound magnetic material 37 and a periphery 40 is filled with the isotropic compound magnetic material 35. Further, FIG. 6B is a schematic sectional view of an inductor 10 according to a ninth embodiment of the present invention taken along the line B-B (refer to FIG. 1A), and the inductor 10 is characterized in that a central core 30 is filled with the isotropic compound magnetic material 35 and a periphery 40 is filled with the anisotropic compound magnetic material 37.

In particular, as shown in the eighth embodiment, when the major axis direction of the soft magnetic metal powder is caused to orient the orthogonal surface direction in the central core 30 in which a magnetic flux passes through the inside of the air core coil 12 in the up and down direction thereof the magnetic flux density of the air core coil 12 can be more increased and the inductance value of the inductor 10 can be more improved than the fourth embodiment in which the central core 30 is filled with the isotropic compound magnetic material 35 (refer to FIG. 4C).

EXAMPLES

Figure 7:
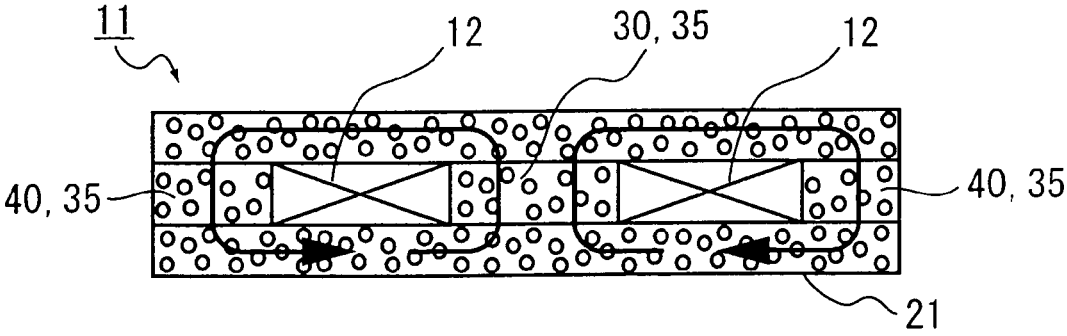
FIG. 7 is a schematic sectional view of an inductor according to a comparative example.

Inductance values [μH] and superimpose direct-current characteristics [A] were simulated as to each inductor 10 of the first embodiment as shown in the sectional view of FIG. 1B, the second embodiment as shown in the sectional view of FIG. 4A, the third embodiment as shown in the sectional view of FIG. 4B, the fourth embodiment as shown in the sectional view of FIG. 4C, and the seventh embodiment as shown in the sectional view of FIG. 5C. Further, as a comparative example, the inductance value and superimpose direct-current characteristics were simulated likewise as to an inductor 11 arranged such that isotropic metal powder was dispersed in compound magnetic sheets 21 layered on both the upper and lower surfaces of an air core coil 12 and further a central core 30 and a periphery 40 were respectively filled with the isotropic compound magnetic material 35 as shown in the sectional view of FIG. 7.

With regard to the anisotropic compound magnetic material 20 and the anisotropic compound magnetic material 37, the effective specific magnetic permeability of the major axis direction (orientation direction) of anisotropic metal powder was set to 30 [−], and the effective specific magnetic permeability of the minor axis direction thereof was set to 5 [−]. Further, the effective specific magnetic permeability of each of the compound magnetic sheet 21 and the isotropic compound magnetic material 35 was set to 10 [−] regardless of the direction thereof.

The effective specific magnetic permeability mentioned in this description is a value obtained by dividing an effective magnetic permeability by the effective magnetic permeability of vacuum ($\mu_0=4\pi\times10^{-7}$ H/m).

And, the diameter of the central core 30 was set to 1 [mm], the width of the winding portion of the air core coil 12 was set to 1 [mm], the width of the periphery 40 was set to 3 [mm], and it was assumed that the inductors 10, 11 were formed in the rotation symmetrical shapes of the above mentioned respective sectional shapes.

Further, the thickness of each of the anisotropic compound magnetic sheet 20, the air core coil 12, the central core 30, and the periphery 40 was set to 300 [μm].

Table 1 shows a result of simulation of the inductance value and the superimpose direct-current characteristics determined under the above mentioned conditions. The inductance value shown in parentheses is shown by a ratio when the inductance value of the comparative example is set to 100.

TABLE 1

| | Inductance Value (μH) | Superimpose Direct-Current Characteristics (A) |
|---|---|---|
| First embodiment | 2.35 (132) | 1.06 |
| Second embodiment | 2.61 (147) | 1.05 |
| Third embodiment | 2.61 (147) | 1.05 |
| Fourth embodiment | 2.78 (156) | 1.03 |
| Seventh embodiment | 2.97 (167) | 1.02 |
| Comparative Example | 1.78 (100) | 1.09 |

It can be found from the comparison of the first embodiment with the comparative example that the inductors 10 of the present invention can greatly improve the inductance value by changing the orientation of the soft magnetic metal powder dispersed in the compound magnetic sheets laminated on the upper and lower surfaces of the air core coil 12 from isotropic orientation to horizontal orientation.

It can be admitted from the results of simulation of the second, third, and fourth embodiments that the inductance value can be more improved by changing the soft magnetic metal powder with which the central core 30 and the periphery 40 are filled, from the material having the horizontal orientation to the isotropic compound magnetic material. Further, it can be admitted from the result of simulation of the seventh embodiment that the inductance value can be more improved by changing the orientation of the soft magnetic metal powder with which the central core 30 and the periphery 40 are filled, to vertical orientation thereof.

What is claimed is:

1. A coil component having flexibility and comprising an air core coil which is spirally formed in a planar state, and an anisotropic compound magnetic sheet which is layered on at least one of upper and lower surfaces of the air core coil, wherein the anisotropic compound magnetic sheet is composed of flat or needle-shaped soft magnetic metal powder having a major axis and a minor axis, and being dispersed in a resin material, and the major axis of the soft magnetic metal powder orients toward an in-plane direction of the air core coil.

2. A coil component having flexibility and comprising an air core coil which is spirally formed in a planar state, and an anisotropic compound magnetic sheet which is layered on at least one of upper and lower surfaces of the air core coil, wherein the anisotropic compound magnetic sheet is composed of flat or needle-shaped soft magnetic metal powder having a major axis and a minor axis, and being dispersed in a resin material, and the major axis of the soft magnetic metal powder orients toward an in-plane direction of the air core coil, and wherein at least one of a central core and a periphery of the air core coil is filled with an isotropic compound magnetic material which is composed of isotropic soft magnetic metal powder dispersed in a resin material.

3. The coil component according claim 1, wherein at least one of a central core and a periphery of the air core coil is filled with an anisotropic compound magnetic material which is composed of flat or needle-shaped soft magnetic metal powder having a major axis and a minor axis, and being dispersed in a resin material, and the major axis of the soft magnetic metal powder dispersed in the anisotropic compound magnetic material orients toward an orthogonal surface direction of the air core coil.

4. The coil component according to claim 2, wherein the central core and the periphery of the air core coil which are not filled with the isotropic compound magnetic material are filled with an anisotropic compound magnetic material which is composed of flat or needle-shaped soft magnetic metal powder having a major axis and a minor axis and being dispersed in a resin material.

5. The coil component according to claim 3, wherein the central core and the periphery of the air core coil which are not filled with the anisotropic compound magnetic material which is composed of flat or needle-shaped soft magnetic metal powder having the major axis and the minor axis and being dispersed in a resin material, is filled with an anisotropic compound magnetic material which dispersed in a resin material in a state that anisotropic metal powder is orthogonally oriented.

6. The coil component according to claim 1, wherein at least one of a central core and a periphery of the air core coil is filled with an anisotropic compound magnetic material which is composed of anisotropic metal powder dispersed in a resin material in a state of orthogonal orientation.

7. The coil component according to claim 6, wherein the central core and the periphery of the air core coil which is not filled with the anisotropic compound magnetic material in which the anisotropic metal powder is dispersed in a resin material in a state of orthogonal orientation is filled with an isotropic compound magnetic material which is composed of isotropic soft magnetic metal powder dispersed in a resin material.

8. The coil component according to claim 3, wherein both the central core and the periphery of the air core coil are filled with the anisotropic compound magnetic material which is composed of flat or needle-shaped soft magnetic metal powder having a major axis and a minor axis, and being dispersed in a resin material.

9. The coil component according to claim 6, wherein the central core and the periphery of the air core coil are filled with the anisotropic compound magnetic material which is composed of anisotropic metal powder dispersed in a resin material in a state of orthogonal orientation.

10. The coil component according to claim 1, wherein an average winding diameter of the air core coil is larger than a thickness of the air core coil.

11. The coil component according to claim 1, wherein the air core coil is a film type coil in which a conductor pattern is formed on a resin film.

12. The coil component according to claim 11, wherein cutouts are formed to positions of the resin film corresponding to the central core and the periphery of the air core coil.

13. The coil component according to claim 2, wherein the central core and the periphery of the air core coil which are not filled with the isotropic compound magnetic material are filled with the isotropic compound magnetic material which is composed of isotropic soft magnetic metal powder dispersed in the resin material.

14. The coil component according to claim 2, wherein the isotropic compound magnetic material filled to the at least one of the central core and the periphery of the air core coil forms magnetic paths, through which a magnetic flux passes in a thickness direction of the coil component, to improve magnetic permeability of the at least one of the central core and the periphery and to increase inductance value thereof.

15. The coil component according to claim 2, wherein an average winding diameter of the air core coil is larger than a thickness of the air core coil.

16. The coil component according to claim 2, wherein the air core coil is a film type coil in which a conductor pattern is formed on a resin film.

17. The coil component according to claim 16, wherein cutouts are formed to positions of the resin film corresponding to the central core and the periphery of the air core coil.

18. The coil component according to claim 1, wherein at least one of a central core and a periphery of the air core coil is filled with an isotropic compound magnetic material which is composed of isotropic soft magnetic metal powder dispersed in a resin material, a particle shape of the isotropic soft magnetic metal powder is approximately spherical, and the isotropic compound magnetic material filled to the at least one of the central core and the periphery of the air core coil forms magnetic paths, through which a magnetic flux passes in a thickness direction of the coil component, to improve magnetic permeability of the at least one of the central core and the periphery and to increase inductance value thereof.

19. The coil component according to claim 18, wherein the central core and the periphery of the air core coil which are not filled with the isotropic compound magnetic material are filled with an anisotropic compound magnetic material which is composed of flat or needle-shaped soft magnetic metal powder having a major axis and a minor axis and being dispersed in a resin material.

20. The coil component according to claim 18, wherein an average winding diameter of the air core coil is larger than a thickness of the air core coil, and the air core coil is a film type coil in which a conductor pattern is formed on a resin film, and cutouts are formed to positions of the resin film corresponding to the central core and the periphery of the air core coil.

* * * * *